US011081032B2

(12) United States Patent
Zheng et al.

(10) Patent No.: US 11,081,032 B2
(45) Date of Patent: Aug. 3, 2021

(54) DISPLAY CIRCUITRY AND METHOD TO UTILIZE SEGMENTED RESISTORS FOR OPTIMIZING FRONT OF SCREEN PERFORMANCE

(71) Applicant: Apple Inc., Cupertino, CA (US)

(72) Inventors: Fenghua Zheng, San Jose, CA (US); Shatam Agarwal, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/574,572

(22) Filed: Sep. 18, 2019

(65) Prior Publication Data

US 2020/0294435 A1 Sep. 17, 2020

Related U.S. Application Data

(60) Provisional application No. 62/818,907, filed on Mar. 15, 2019.

(51) Int. Cl.
*G09G 3/20* (2006.01)

(52) U.S. Cl.
CPC ..... *G09G 3/20* (2013.01); *G09G 2310/0291* (2013.01); *G09G 2320/0673* (2013.01)

(58) Field of Classification Search
CPC ..... G09G 3/20–2007; G09G 3/2074; G09G 3/3241; G09G 3/325; G09G 3/3275–3291; G09G 3/3685–3696; G09G 2300/0871; G09G 2310/027–0275; G09G 2310/0289; G09G 2310/0291; G09G 2320/0204; G09G 2320/0233–0242; G09G 2320/0252; G09G 2320/0271; G09G 2320/0276; G09G 2320/04; G09G 2320/0626–0673; G09G 2330/06; G09G 2340/06
See application file for complete search history.

(56) References Cited

U.S. PATENT DOCUMENTS

| | | | | |
|---|---|---|---|---|
| 8,854,294 | B2 | 10/2014 | Sakariya | |
| 9,640,128 | B2 | 5/2017 | Xu | |
| 2005/0012700 | A1* | 1/2005 | Hara | G09G 3/3688 345/89 |
| 2006/0087483 | A1* | 4/2006 | Takada | G09G 3/3688 345/89 |
| 2012/0206506 | A1* | 8/2012 | Kim | G09G 3/20 345/690 |
| 2013/0135362 | A1 | 5/2013 | Kim et al. | |

* cited by examiner

*Primary Examiner* — Nathan Danielsen
(74) *Attorney, Agent, or Firm* — Aikin & Gallant, LLP

(57) ABSTRACT

Aspects of the subject technology relate to control circuitry for displays. A display control circuitry includes a plurality of amplifiers to drive gamma signals for a pixel array having a plurality of pixels of a display and a segmented resistor string coupled to the plurality of amplifiers. The resistor string includes a plurality of resistor segments with a resistor segment being designed with a modified resistance to modify display performance parameters including at least one of a settling time of an associated gamma signal, a power supply rejection ratio (PSRR) of an amplifier of the plurality of amplifiers, or an output voltage offset of an amplifier of the plurality of amplifiers.

20 Claims, 9 Drawing Sheets

DISPLAY CIRCUITRY AND METHOD TO UTILIZE SEGMENTED RESISTORS FOR OPTIMIZING FRONT OF SCREEN PERFORMANCE

RELATED APPLICATIONS

This application claims the benefit of priority of U.S. Provisional Application No. 62/818,907 filed Mar. 15, 2019 which is incorporated herein by reference.

TECHNICAL FIELD

The present description relates generally to electronic devices with displays, and more particularly, but not exclusively, to electronic devices with displays having display control circuitry to utilize segmented resistors for optimizing front of screen performance.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays (LCDs) typically include an array of display pixels arranged in pixel rows and pixel columns. Liquid crystal displays commonly include a backlight unit and a liquid crystal display unit with individually controllable liquid crystal display pixels.

Gamma correction, or often simply gamma, is a nonlinear operation used to encode and decode luminance or tristimulus values in video or still image systems. Gamma translates between a human eye's light sensitivity and sensitivity of an image capturing device (e.g., camera). Gamma correction controls the overall brightness of an image. Images will appear to be bleached out, or too dark if gamma correction is improper.

SUMMARY OF THE DESCRIPTION

In accordance with various aspects of the subject disclosure, a display control circuitry with a display is provided. The display control circuitry includes a plurality of amplifiers to drive gamma signals for a pixel array having a plurality of pixels of a display and a segmented resistor string coupled to the plurality of amplifiers. The resistor string includes a plurality of resistor segments with a resistor segment being designed with a modified resistance to modify (e.g., improve) display performance parameters including at least one of a settling time of an associated gamma signal, a power supply rejection ratio (PSRR) of an amplifier, or an output voltage offset of an amplifier.

In accordance with other aspects of the subject disclosure, an electronic device having a display is provided. The display includes a display control circuitry to control operations of the display and column driver circuitry coupled to the display control circuitry. The column driver circuitry comprises a plurality of amplifiers to drive gamma signals for a pixel array having a plurality of pixels of the display and a segmented resistor string coupled to the plurality of amplifiers. The resistor string includes a plurality of resistor segments with at least one resistor segment being designed with a modified resistance to modify (e.g., improve) display performance parameters including at least one of a settling time of an associated gamma signal, a power supply rejection ratio (PSRR) of an amplifier, or an output voltage offset of an amplifier.

In accordance with other aspects of the subject disclosure, a display driver circuitry includes a gamma unit to generate a gamma curve for a mapping of luminance to grey level for a display. The gamma unit includes a plurality of amplifiers to drive gamma signals for a pixel array having a plurality of pixels of a display and a segmented resistor string coupled to the plurality of amplifiers. The resistor string includes a plurality of resistor segments with a resistor segment being designed with a modified resistance to modify (e.g., improve) display performance parameters including at least one of a settling time of an associated gamma signal, a power supply rejection ratio (PSRR) of an amplifier, or an output voltage offset of an amplifier.

In accordance with other aspects of the subject disclosure, a computer implemented method for a display includes monitoring, with processing circuitry, display performance parameters of the display, determining, with the processing circuitry, whether any display performance parameter is out of electrical specification, and determining at least one resistor segment of a segmented resistor string of a gamma unit that corresponds with the display performance parameter being out of electrical specification.

BRIEF DESCRIPTION OF THE DRAWINGS

Certain features of the subject technology are set forth in the appended claims.

However, for purpose of explanation, several embodiments of the subject technology are set forth in the following figures.

DETAILED DESCRIPTION

Figure 1:
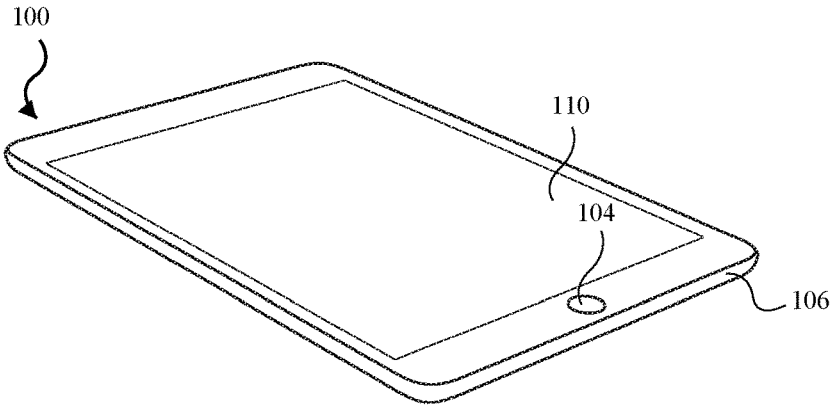
FIG. 1 illustrates a perspective view of an example electronic device having a display in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides electronic devices such as cellular telephones, media players, tablet computers, laptop computers, set-top boxes, smart watches, wireless access points, and other electronic equipment that include light-emitting diode arrays such as in backlight units of displays. Displays are used to present visual information and status data and/or may be used to gather user input data. A display includes an array of display pixels. Each display pixel may include one or more colored subpixels for displaying color images. For example, each display pixel may include a red subpixel, a green subpixel, and blue subpixel. It should be appreciated that, although the description that follows often describes operations associated with a display pixel, in implementations in which each display pixel includes multiple subpixels, the circuitry and operations described herein can be applied and/or performed, per color, for each subpixel of the display pixel.

Each display pixel may include a layer of liquid crystals disposed between a pair of electrodes operable to control the orientation of the liquid crystals. Controlling the orientation of the liquid crystals controls the polarization of backlight. This polarization control, in combination with polarizers on opposing sides of the liquid crystal layer, allows light passing into the pixel to be manipulated to selectively block the light or allow the light to pass through the pixel.

The backlight unit includes one or more light-emitting diodes (LEDs) such as one or more strings and/or arrays of light-emitting diodes that generate the backlight for the display. In various configurations, strings of light-emitting diodes may be arranged along one or more edges of a light guide plate that distributes backlight generated by the strings to the LCD unit, or may be arranged to form a two-dimensional array of LEDs.

In a display, control circuitry coupled to the array of display pixels and to the backlight unit receives data for display from system control circuitry of the electronic device and, based on the data for display, generates and provides control signals for the array of display pixels and for the LEDs of the backlight unit.

An illustrative electronic device may be provided with light-emitting diodes as shown in FIG. 1. In the example of FIG. 1, device 100 has been implemented using a housing that is sufficiently small to be portable and carried by a user (e.g., device 100 of FIG. 1 may be a handheld electronic device such as a tablet computer or a cellular telephone). As shown in FIG. 1, device 100 may include a display such as display 110 mounted on the front of housing 106. Display 110 may be substantially filled with active display pixels or may have an active portion and an inactive portion. Display 110 may have openings (e.g., openings in the inactive or active portions of display 110) such as an opening to accommodate button 104 and/or other openings such as an opening to accommodate a speaker, a light source, or a camera.

Display 110 may be a touch screen that incorporates capacitive touch electrodes or other touch sensor components or may be a display that is not touch-sensitive. Display 110 may include display pixels formed from light-emitting diodes (LEDs), organic light-emitting diodes (OLEDs), plasma cells, electrophoretic display elements, electrowetting display elements, liquid crystal display (LCD) components, or other suitable display pixel structures.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer (e.g., computing system 900 of FIG. 9) such as a computer that is integrated into a display such as a computer monitor, a laptop computer, a somewhat smaller portable device such as a wrist-watch device, a pendant device, or other wearable or miniature device, a media player, a gaming device, a navigation device, a computer monitor, a television, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations. An LED backlight array may also be provided for the keyboard and/or other illuminated portions of device 100.

In some implementations, electronic device 100 may be provided in the form of a computer integrated into a computer monitor. Display 110 may be mounted on a front surface of housing 106 and a stand may be provided to support housing (e.g., on a desktop).

Figure 2:
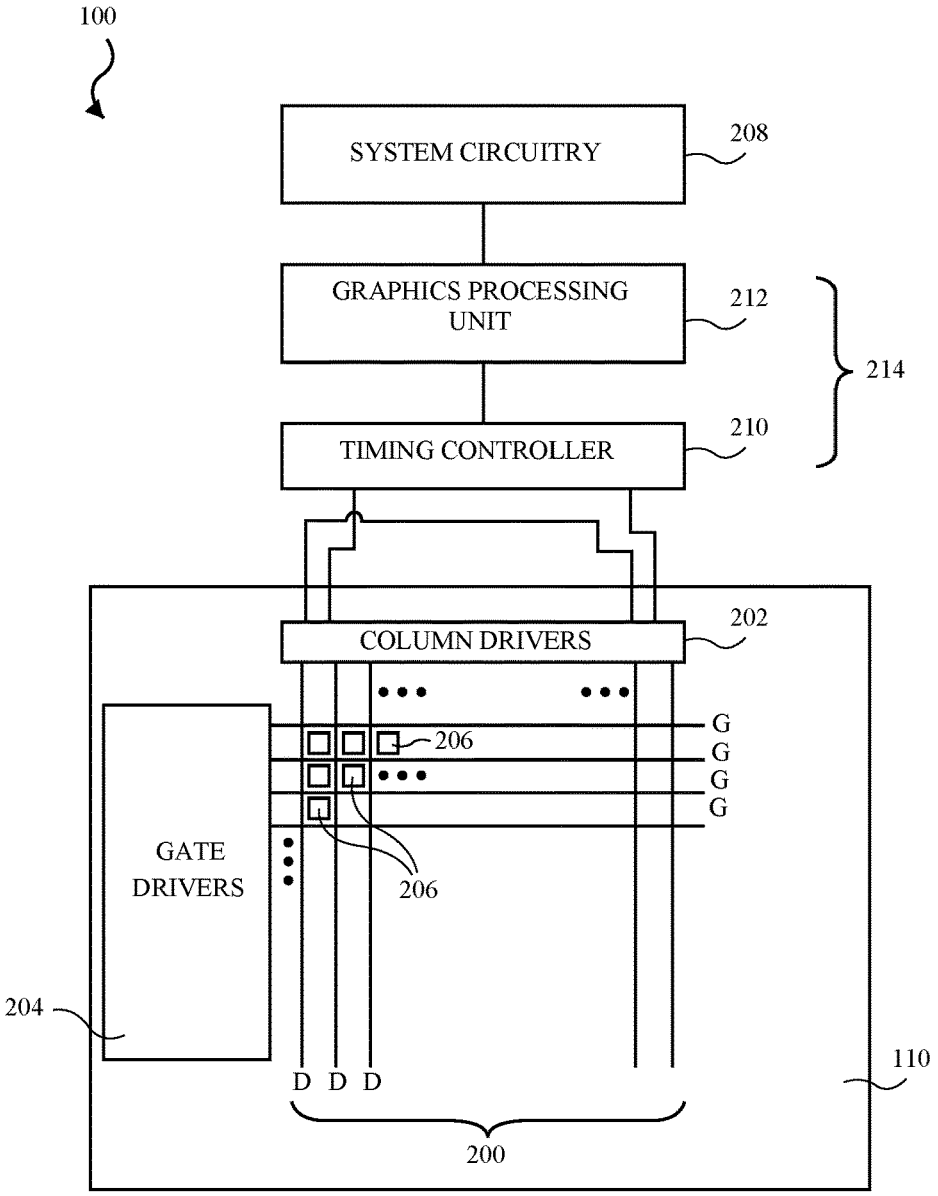
FIG. 2 is a schematic diagram of device 100 showing illustrative circuitry that may be used in displaying images for a user of device 100 on pixel array 200 of display 110 in accordance with some embodiments.

FIG. 2 is a schematic diagram of device 100 showing illustrative circuitry that may be used in displaying images for a user of device 100 on pixel array 200 of display 110. As shown in FIG. 2, display 110 may include column driver circuitry 202 that drives data signals (analog voltages) onto the data lines D of array 200. Gate driver circuitry 204 may drive gate line signals onto gate lines G of array 200.

Using the data lines D and gate lines G, display pixels 206 may be operated to display images on display 110 for a user.

In some implementations, gate driver circuitry 204 may be implemented using thin-film transistor circuitry on a display substrate such as a glass or plastic display substrate or may be implemented using integrated circuits that are mounted on the display substrate or attached to the display substrate by a flexible printed circuit or other connecting layer. In some implementations, column driver circuitry 202 may be implemented using one or more column driver integrated circuits that are mounted on the display substrate or using column driver circuits mounted on other substrates.

Device 100 may include system circuitry 208. System circuitry 208 may include one or more different types of storage such as hard disk drive storage, nonvolatile memory (e.g., flash memory or other electrically-programmable-read-only memory), volatile memory (e.g., static or dynamic random-access-memory), magnetic or optical storage, permanent or removable storage and/or other non-transitory storage media configure to store static data, dynamic data, and/or computer readable instructions for processing circuitry in system circuitry 208. Processing circuitry in system circuitry 208 may be used in controlling the operation of device 100. Processing circuitry in system circuitry 208 may sometimes be referred to herein as system circuitry or a system-on-chip (SOC) for device 100.

The processing circuitry may be based on a processor such as a microprocessor and other suitable integrated circuits, multi-core processors, one or more application specific integrated circuits (ASICs) or field programmable gate arrays (FPGAs) that execute sequences of instructions or code, as examples. In one suitable arrangement, system circuitry 208 may be used to run software for device 100, such as internet browsing applications, email applications, media playback applications, operating system functions, software for capturing and processing images, software implementing functions associated with gathering and processing sensor data, software that makes adjustments to display brightness and touch sensor functionality, etc.

During operation of device 100, system circuitry 208 may produce data that is to be displayed on display 110. This display data may be provided to display control circuitry such as graphics processing unit (GPU) 212. For example, display frames for display using pixels 206 may be provided from system circuitry 208 to GPU 212. GPU 212 may process the display frames and provide processed display frames to timing controller integrated circuit 210.

Timing controller 210 may provide digital display data to column driver circuitry 202 using paths 216. Column driver circuitry 202 may receive the digital display data from timing controller 210. Using digital-to-analog converter circuitry within column driver circuitry 202, column driver circuitry 202 may provide corresponding analog output signals on the data lines D running along the columns of display pixels 206 of array 200.

Graphics processing unit 212 and timing controller 210 may sometimes collectively be referred to herein as display control circuitry 214. Display control circuitry 214 may be used in controlling the operation of display 110. Display control circuitry 214 may sometimes be referred to herein as a display driver, a display controller, a display driver integrated circuit (IC), or a driver IC. Graphics processing unit 212 and timing controller 210 may be formed in a common package (e.g., an SOC package) or may be implemented separately (e.g., as separate integrated circuits). In some implementations, timing controller 210 may be implemented separately as a display driver, a display controller, a display driver integrated circuit (IC), or a driver IC that receives processed display data from graphics processing unit 212. Accordingly, in some implementations, graphics processing unit 212 may be considered to be part of the system circuitry (e.g., together with system circuitry 208) that provides display data to the display control circuitry (e.g., implemented as timing controller 210, gate drivers 204, and/or column drivers 202). Although a signal gate line G and a single data line D for each pixel 206 are illustrated in FIG. 2, this is merely illustrative and one or more additional row-wise and/or column-wise control lines may be coupled to each pixel 206 in various implementations.

Digital grey levels for operating display pixels can have associated values from, for example, 0 to 255. Due to properties inherent in liquid crystals, although a change from a grey level of zero to a grey level of 255 can be achieved relatively quickly by applying a voltage corresponding to the 255 grey level to the pixel, a change from, for example, 0 to a different grey level can include a delay that can have visible effects on the display.

Issues with gamma can also have visible effects on the display. A settling time of a dynamical system such as an amplifier or other output device is the time elapsed from the application of an ideal instantaneous step input to the time at which the amplifier output has entered and remained within a specified error band. A gamma settling time issue (e.g., for settling time greater than a threshold), out of electrical specification power supply rejection ratio (PSRR) for an amplifier, or out of electrical specification output voltage offset for an amplifier can cause visible effects on the display. In one example, PSRR is an amount of noise from a power supply that a particular device (e.g., electronic amplifier, operational amplifier, etc.) or voltage regulator can reject. PSRR indicates an ability of an electronic circuit to suppress any power supply variations to an output signal of the electronic device. In another example, an output voltage offset is an output of an operational amplifier when the two inputs are shorted together. This output voltage offset can be caused by mismatching from the input terminals.

Figure 3A:
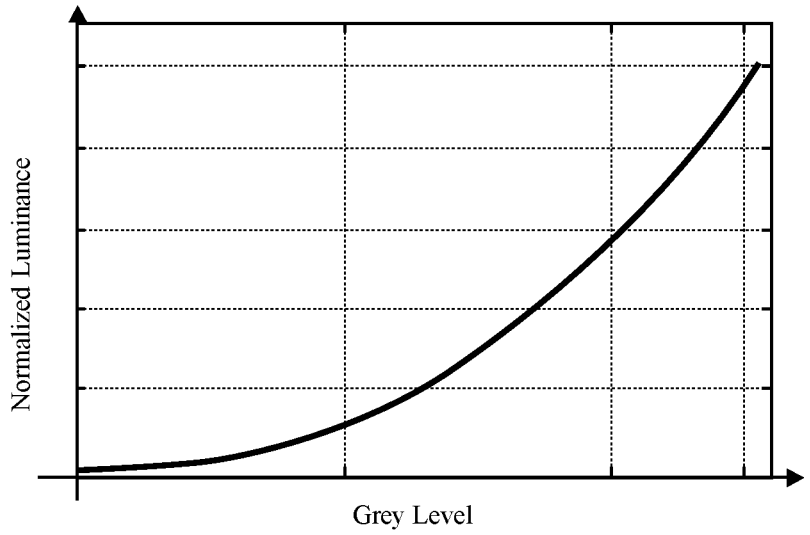
FIG. 3A illustrates a gamma curve (e.g., ideal 2.2 gamma, Perceptual quantizer gamma curve) for a display in accordance with some embodiments.
Figure 3B:
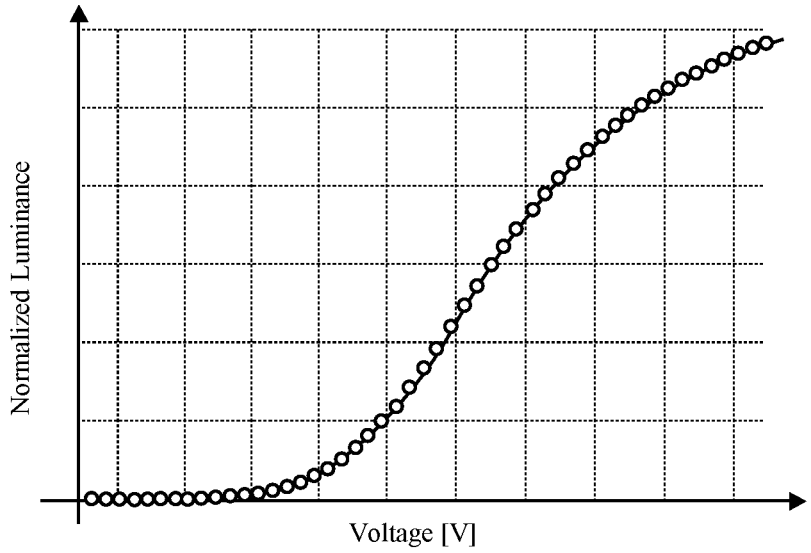
FIG. 3B illustrates luminance versus voltage curve in accordance with some embodiments.
Figure 3C:
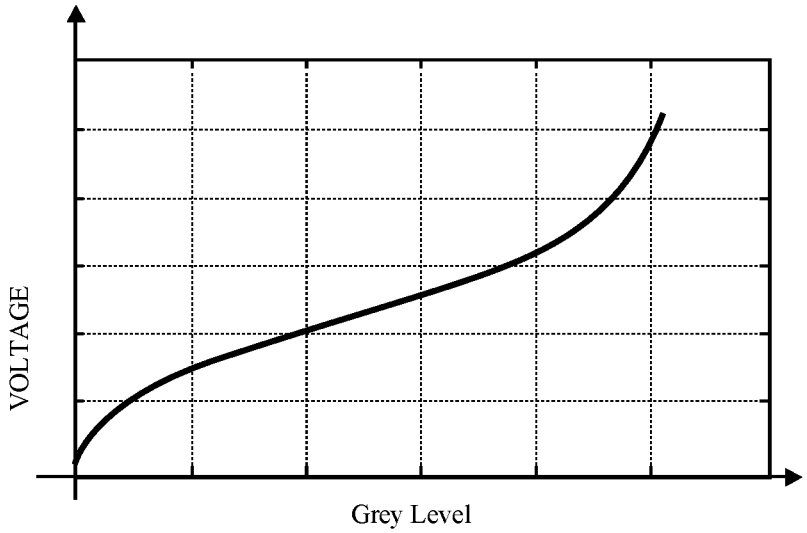
FIG. 3C illustrates a voltage versus grey level curve in accordance with some embodiments.
Figure 3D:
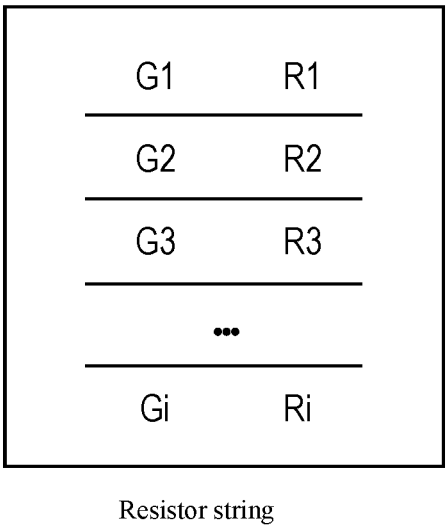
FIG. 3D illustrates grey levels (e.g., G1, G2, etc.) and corresponding resistor values (e.g., R1, R2, etc.) in accordance with some embodiments.

A gamma curve (e.g., ideal 2.2 gamma, Perceptual quantizer gamma curve) for a display provides a mapping between luminance to a grey level (e.g., 0-255) as illustrated in FIG. 3A. A differential of a desired gamma curve for a display provides a resistance ratio needed for a resistor string to perform this gamma function. FIG. 3B illustrates luminance versus voltage curve. FIG. 3C illustrates a voltage versus grey level curve. Data from FIGS. 3A and 3B is combined to generate FIG. 3C. FIG. 3D illustrates grey levels (e.g., G1, G2, etc.) and corresponding resistor values (e.g., R1, R2, etc.).

Improvements to a gamma unit having an unbalanced resistor string can reduce settling time of gamma signals to facilitate improved image quality on a display. The unbalanced resistor string can be designed by modifying resistance values of at least one resistor segment to reduce gamma settling time for the at least one resistor segment having settling time issues.

Figure 4:
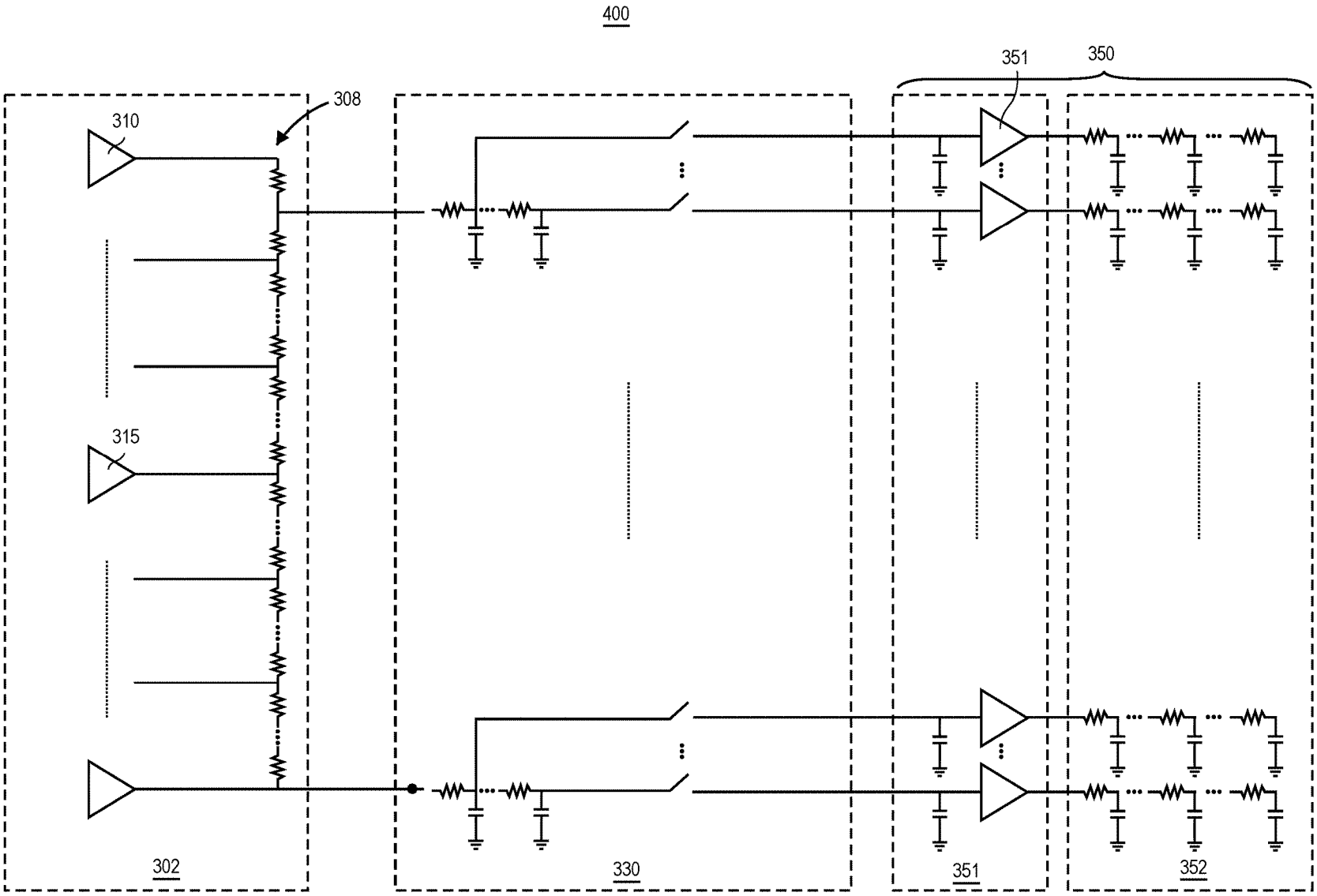
FIG. 4 shows a schematic diagram of display circuitry 400 that includes a gamma unit 302 having exemplary circuitry to generate gamma signals in accordance with one embodiment.

FIG. 4 shows a schematic diagram of display circuitry 400 that includes a gamma unit 302 having exemplary circuitry to generate gamma signals in accordance with one embodiment. The gamma unit 302 includes gamma amplifiers 310, 315, n for driving gamma signals to a panel for driving data signals onto the data lines of display circuitry 350 (e.g., panel 200), and a resistor string 308 having segments in one example. A gamma stage 330 includes gamma line RC and digital to analog (DAC) switches for selecting tapping voltages from the resistor string 308. The display circuitry 350 includes main amplifiers 351 to drive data signals to pixels that are represented with panel load 352 including resistors and capacitors. In one example, the gamma unit 302 drives gamma voltages for red, green, and blue pixels with time multiplexing. In another example, the gamma unit 302 drives gamma voltages for a first color of pixels, another gamma unit drives gamma voltages for a second color of pixels, and an additional gamma unit drives gamma voltages for a third color of pixels.

Figure 5:
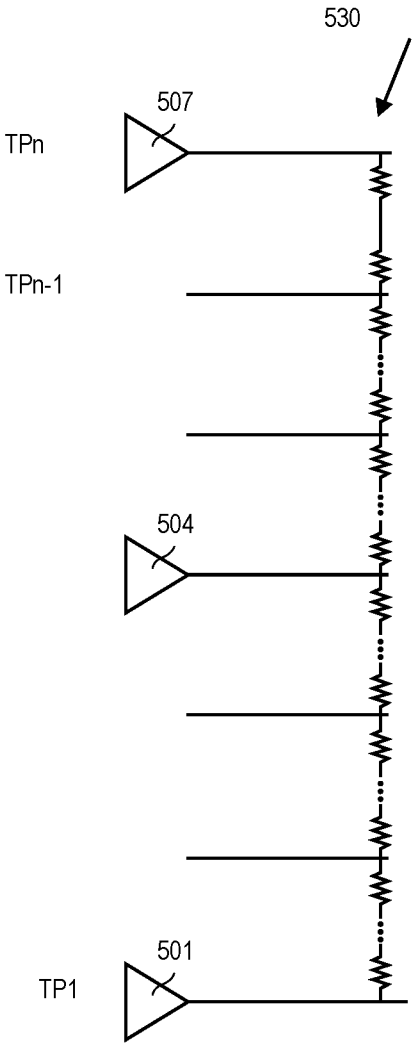
FIG. 5 illustrates amplifiers (e.g., 501, 504, 507) coupled to an unsegmented resistor string 530 for a gamma function.

FIG. 5 illustrates amplifiers (e.g., 501, 504, 507) coupled to an unsegmented resistor string 530 for a gamma function. Each resistor may have a similar value and a resistance ratio of the unsegmented resistor string is designed to perform the gamma function.

Figure 6:
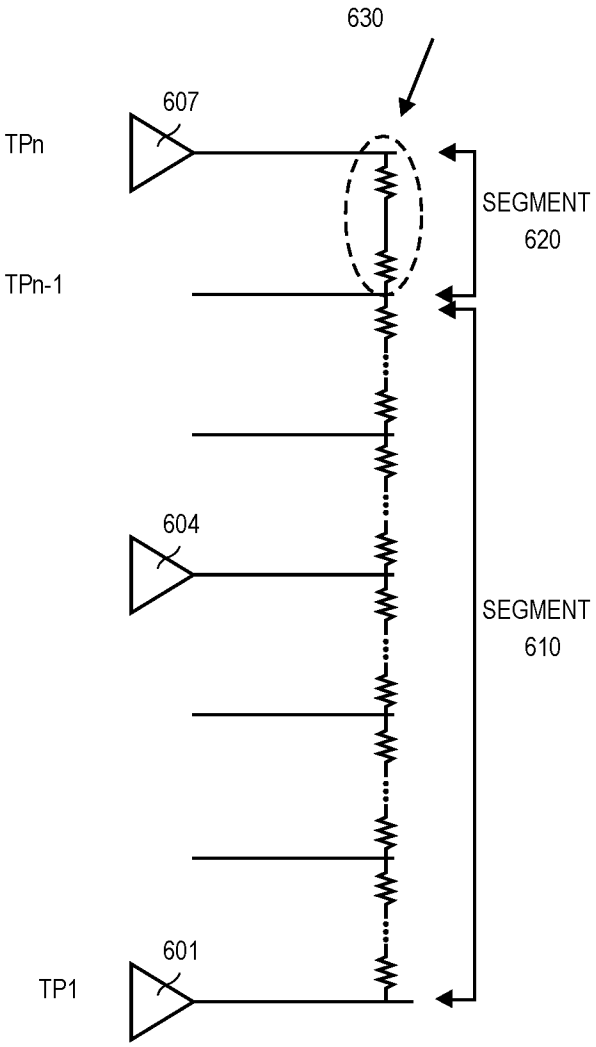
FIG. 6 illustrates amplifiers (e.g., 601, 604, 607) coupled to a segmented resistor string 630 for a gamma function in accordance with one embodiment.

FIG. 6 illustrates amplifiers (e.g., 601, 604, 607) coupled to a segmented resistor string 630 for a gamma function in accordance with one embodiment. The resistor string 630 is designed to perform the gamma function. Upon detection of a display performance parameter (e.g., a settling time greater than a threshold settling time, PSRR, output voltage offset) that is outside of a design electrical specification for any resistor segment, a resistance for this segment is modified, in one example, to lower the resistance and thus modify the display performance parameter (e.g., reduce a potential settling time issue, PSRR, output voltage offset) to be within a design electrical specification.

For FIG. 6, during design analysis of the display control circuitry or the column driver circuitry 202, processing circuitry determines if a display performance parameter is outside of a design electrical specification and whether a resistor segment may affect this display performance parameter. If so, a segment may have a corresponding high resistance that exceeds a threshold resistance. In this example, segment 620 has a high resistance that corresponds to a display performance parameter being outside of the design electrical specification. The processing circuitry modifies (e.g., decreases, increases) the resistance of segment 620 while maintaining a resistance ratio between resistors within segment 620. In this manner, the resistance of the segmented string 630 is customized to obtain a desired gamma curve by maintaining tap point voltages on the segmented resistor string even if tap point voltages need to be forced, maintaining resistance ratio for resistors within a segment, and thus improving display performance parameters (e.g., reducing settling time for any segments having settling time issues, PSRR, output voltage offset). Power consumption for this segmented resistor string is also reduced significantly in comparison to reducing resistance of each segment, which would increase power substantially. Thus, for a same settling behavior of reducing resistance of all resistor segments, this present design achieves low power and optimized resistor sizing.

Figure 7A:
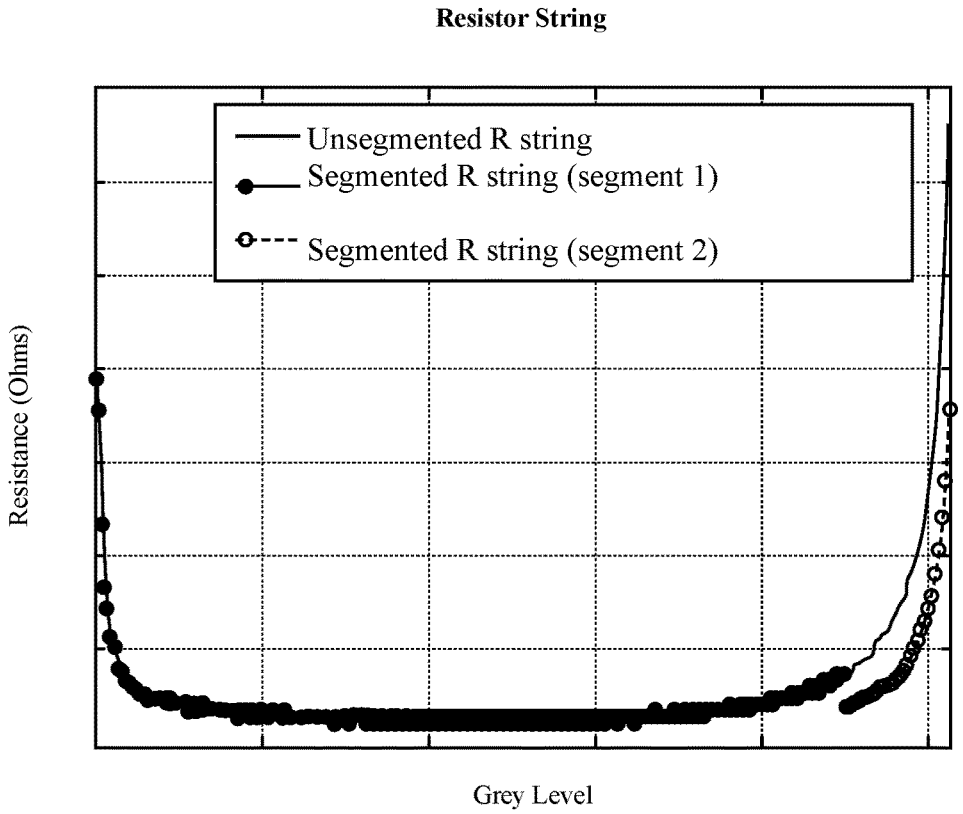
FIG. 7A illustrates a chart of resistance versus grey level for an unsegmented R string (e.g., string 530) and a segmented R string (e.g., string 630) in accordance with one embodiment.

FIG. 7A illustrates a chart of resistance versus grey level for an unsegmented R string (e.g., string 530) and a segmented R string (e.g., string 630) in accordance with one embodiment. The resistors of the unsegmented string that provide gamma voltages for high grey levels have high resistance (far rights side of chart). The resistors from segment 620 of the segmented string have significantly lower values and thus improved display performance parameters (e.g., reduce settling time, PSRR, output voltage offset) .

Figure 7B:
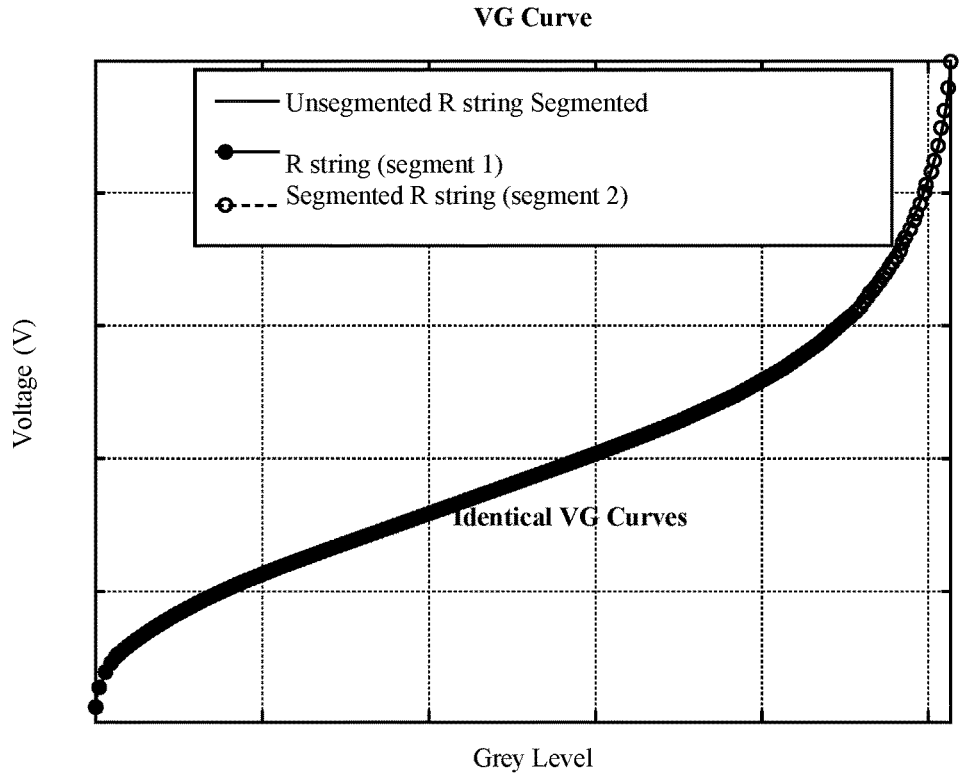
FIG. 7B illustrates that the unsegmented and segmented resistor strings have the same gamma voltage curve, which plots voltage versus grey level.

FIG. 7B illustrates that the unsegmented and segmented resistor strings have the same gamma voltage curve, which plots voltage versus grey level. Thus, the segmented R string (e.g., string 630) reduces resistance in any high-resistance segment while still maintaining the same gamma voltage curve. Any segment of the segmented R string can be designed with reduced resistance based on requirements of a particular design electrical specification.

Figure 7C:
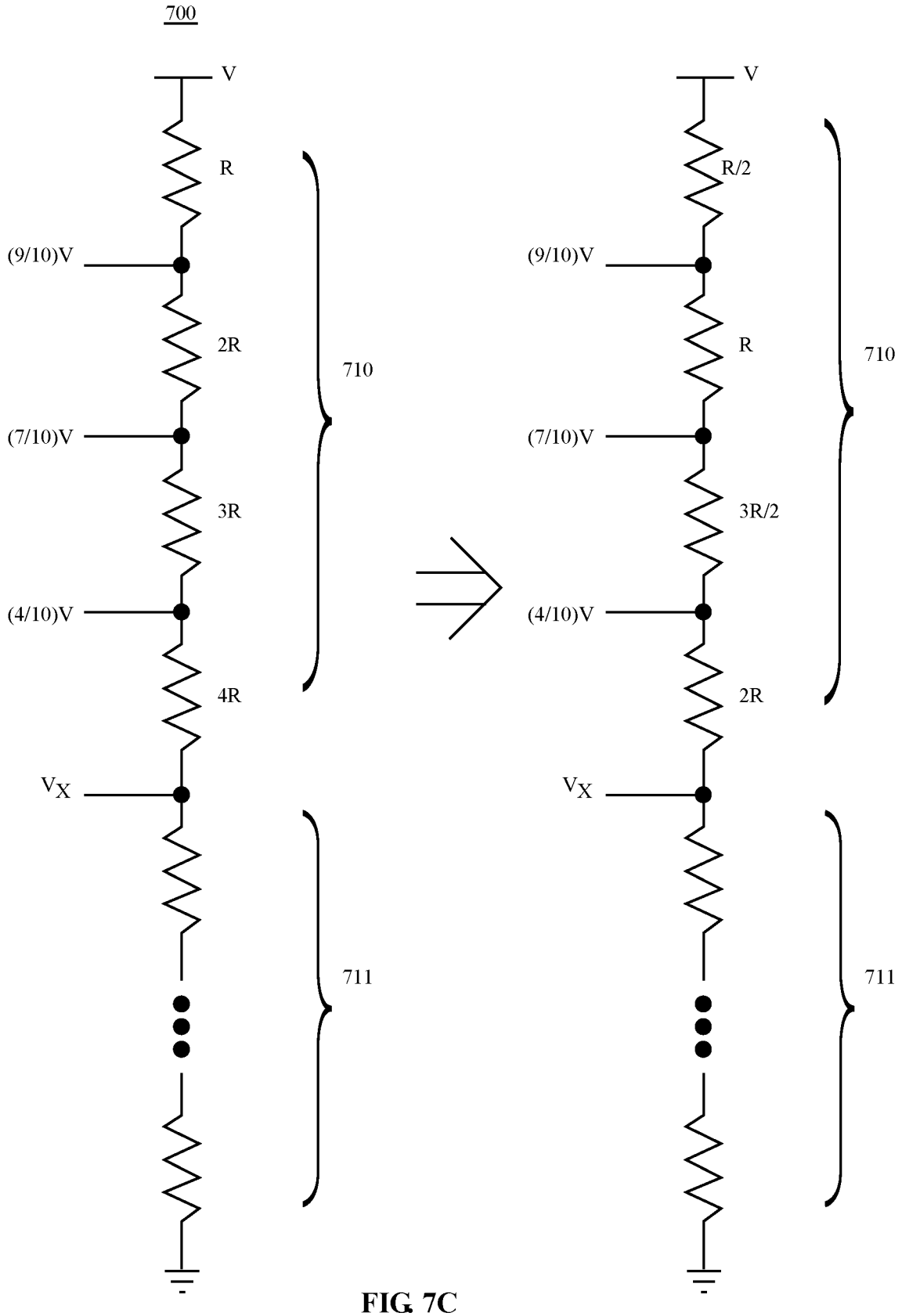
FIG. 7C illustrate a segmented resistor string for a gamma function in accordance with another embodiment.

FIG. 7C illustrates a segmented resistor string for a gamma function in accordance with another embodiment. A resistance ratio of the resistor string is designed to perform the gamma function for a desired gamma curve. Upon detection of a display performance parameter that is outside of a design electrical specification for any of the segments 710-711, the resistance for the out of electrical specification segment having a high resistance is modified to lower the resistance and thus the display performance parameter will then be within electrical specification.

In one example, this resistor string 700 has segment 710 with resistor values of R, 2R, 3R, and 4R, respectively, as illustrated on left side of FIG. 7C. The tapping point voltages are 9/10V, 7/10V, 4/10V, and Vx. For FIG. 7C in one example, processing circuitry determines an out of electrical specification display performance parameter and corresponding high resistance for segment 710 while other segments including segment 711 have acceptable resistance values. The processing circuitry modifies (e.g., lowers by any amount, lowers 3R to 3R/2, etc.) the resistance of segment 710 from a total resistance of 10R to a total resistance of 5R as illustrated on right side of FIG. 7C while maintaining a resistance ratio between resistors in this segment. The tapping point voltage at Vx will change due to the change in the resistance of segment 710. This present design forces the tapping point voltage Vx to remain the same for both the 10R and 5R resistance values of segment 710. No changes occur to the segment 711.

Figure 8:
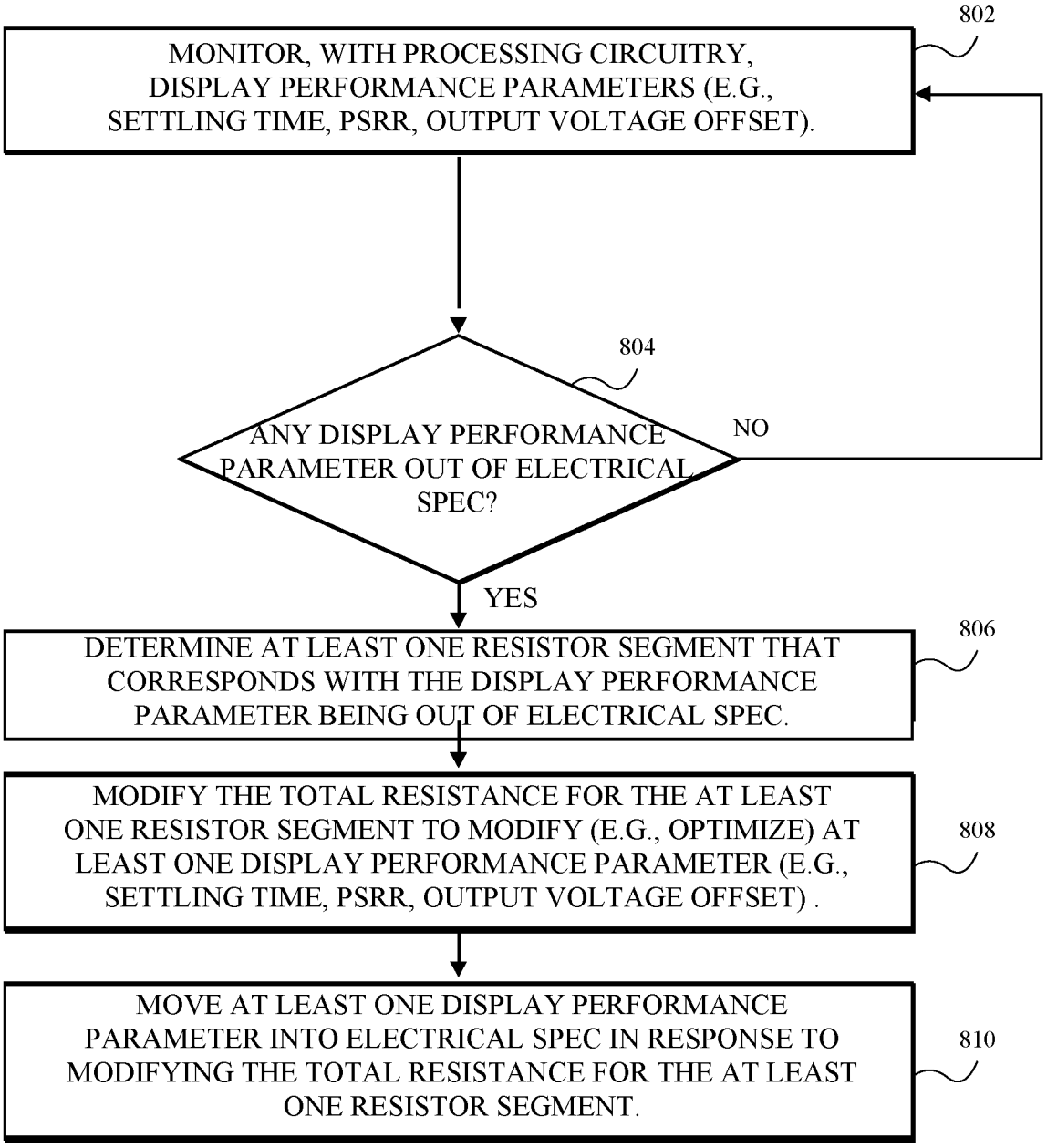
FIG. 8 depicts a flow diagram of an example process for improving display performance parameters (e.g., settling time reduction for a gamma function, PSRR, output offset voltage) in accordance with one embodiment.

In this manner, the resistance of the segmented string 710 is customized to obtain a desired gamma curve by maintaining tapping point voltages (e.g., 9/10V, 7/10V, 4/10V, Vx) even if tapping point voltages need to be forced to be constant, and thus moving display performance parameters from being out of electrical specification to being within electrical specification (e.g., reducing settling time for any segments having settling time issues, PSRR, voltage offset). Power consumption for this segmented resistor string is also reduced in comparison to reducing resistance of each segment (e.g., if resistance of segments 710 and 711 were each reduced by ½), which would increase power substantially. FIG. 8 depicts a flow diagram of an example process for improving display performance parameters (e.g., settling time reduction for a gamma function, PSRR, voltage offset) in accordance with one embodiment. Front of screen performance can be characterized with a number of electrical specifications. The electrical specifications related to display driver IC include but not limited to settling time, power supply rejection ratio (PSRR) and output voltage offset.

For explanatory purposes, the blocks of the example process of FIG. 8 are described herein as occurring in series, or linearly. However, multiple blocks of the example process of FIG. 8 may occur in parallel. In addition, the blocks of the example process of FIG. 8 need not be performed in the order shown and/or one or more of the blocks of the example process of FIG. 8 need not be performed. Processing circuitry of system circuitry, GPU, timing controller, column drivers, or gamma unit may perform the operations of FIG. 8. The processing circuitry may include hardware (circuitry, dedicated logic, etc.), software (such as is run on a general purpose computer system or a dedicated machine or a device), or a combination of both.

In the depicted example flow diagram during a design phase analysis, at operation 802, the processing circuitry monitors display performance parameters (e.g., settling time, PSRR, output voltage offset). At operation 804, the processing circuitry determines whether any display performance parameter (e.g., settling time, PSRR, output voltage offset) is out of electrical specification (e.g., exceeds an acceptable operating range). At operation 806, the processing circuitry determines at least one resistor segment of a segmented resistor string of a gamma unit that corresponds with the display performance parameter being out of electrical specification. At operation 808, the processing circuitry modifies the total resistance for any segment to modify (e.g., optimize) at least one display performance parameter (e.g., settling time, PSRR, output voltage offset). At operation 810, the at least one display performance parameter (e.g., settling time, PSRR, output voltage offset) moves into electrical specification in response to the modification of the resistance for the at least one resistor segment.

Figure 9:
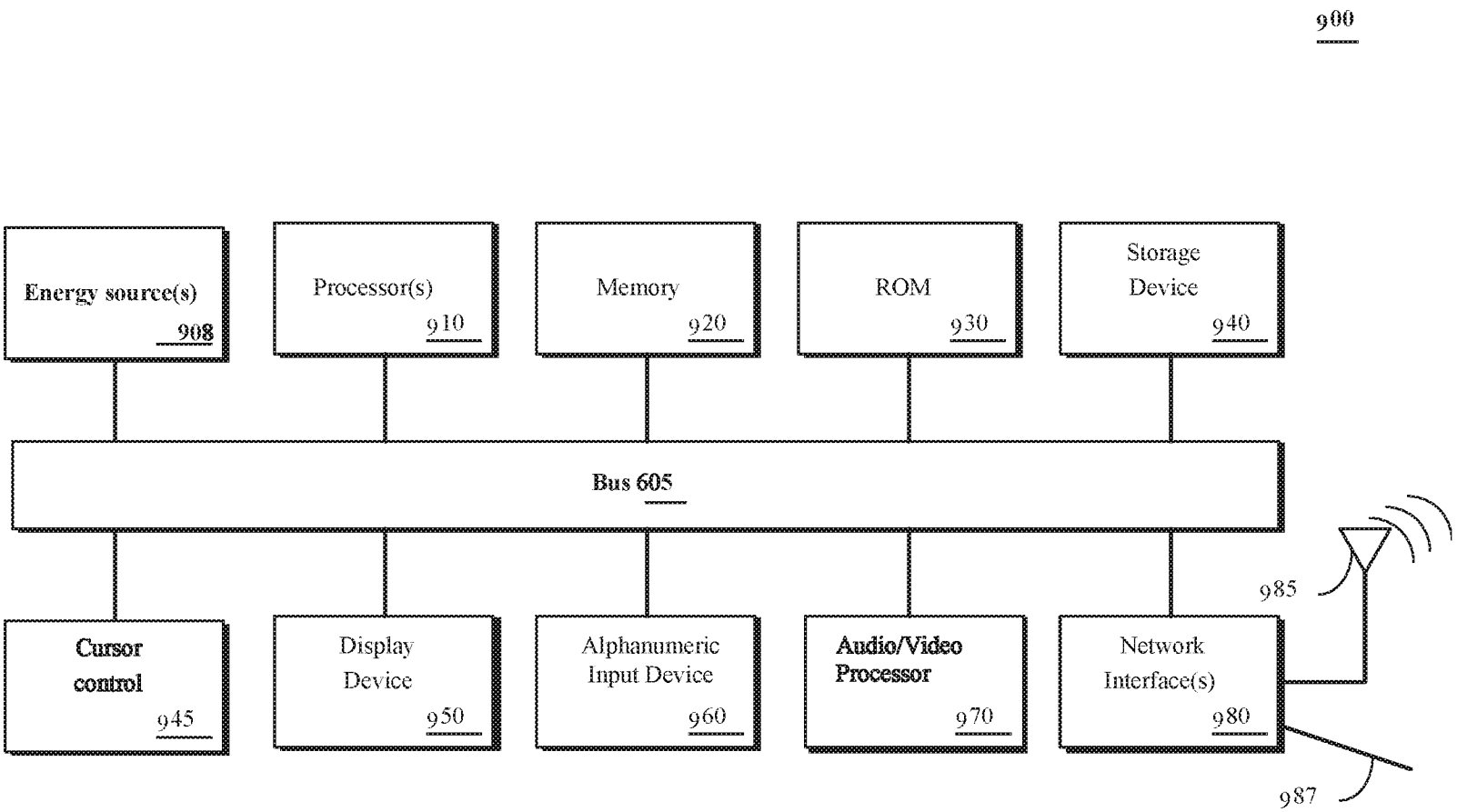
FIG. 9 illustrates, in block form, a computing system 900 that can implement improved display performance parameters (e.g., settling time reduction for a gamma function) in accordance with one embodiment, according to some embodiments.

FIG. 9 illustrates, in block form, a computing system 900 that can implement improved display performance parameters (e.g., (e.g., settling time, PSRR, output voltage offset)) in accordance with one embodiment, according to some embodiments.

The computing system illustrated in FIG. 9 is intended to represent a range of computing systems (either wired or wireless) including, for example, desktop computer systems, laptop computer systems, tablet computer systems, cellular telephones, personal digital assistants (PDAs) including cellular-enabled PDAs, set top boxes, entertainment systems or other consumer electronic devices.

Alternative computing systems may include more, fewer and/or different components. The computing system of FIG. 9 may be used to provide the computing device and/or the server device.

Computing system 900 includes bus 905 or other communication device to communicate information, and processor(s) 910 coupled to bus 905 that may process information.

While computing system 900 is illustrated with a single processor, computing system 900 may include multiple processors and/or co-processors in processor 910. Processor 910 can include a plurality of core types. Processor 910 can comprise a symmetric multiprocessing complex (SMP) having a plurality of cores that are configured in a plurality of different configurations. Processor 910 can comprise an asymmetric multiprocessing system having a plurality of different core types, each having one or more cores. Core types can include performance cores, efficiency cores, graphics cores, and arithmetic processing cores. A performance core can have an architecture that is designed for very high throughput and may include specialized processing such as pipelined architecture, floating point arithmetic functionality, graphics processing, or digital signal processing. A performance core may consume more energy per instruction than an efficiency core. An efficient processor may include a general purpose processor that can process input/output (I/O) such as for block storage, data streams, interfacing to a display, processing integer arithmetic, and other general processing functionality. An efficient core may consume less energy per instruction than a performance core. Processor 910 can comprise a system on a chip (SoC).

Computing system 900 further may include random access memory (RAM) or other dynamic storage device 920 (referred to as main memory), coupled to bus 905 and may store information and instructions that may be executed by processor 910. The instructions may facilitate functions as described herein including gamma functions and modifying resistor segments to improve display performance parameters. Main memory 920 may also be used to store temporary variables or other intermediate information during execution of instructions by processor 910.

Computing system 900 may also include read only memory (ROM) 930 and/or other static storage device 940 coupled to bus 905 that may store static information and instructions for processor complex 910. Data storage device 940 may be coupled to bus 905 to store information and instructions. Data storage device 940 such as flash memory or a magnetic disk, optical disc, solid state disc, writeable or rewriteable compact disc, and corresponding drive may be coupled to computing system 900.

Computing system 900 may further include a power or energy source 908. Computing system 900 may also be coupled via bus 905 to display device 950, such as a liquid crystal display (LCD), light emitting diode (LED) display, or touch screen, to display information to a user. Computing system 900 can also include an alphanumeric input device 960, including alphanumeric and other keys, which may be coupled to bus 905 to communicate information and command selections to processor 910. An alphanumeric keypad can be implemented as keypad images on a touch screen display. Another type of user input device is cursor control 945, such as a touchpad, a mouse, a trackball, touch screen input or cursor direction keys to communicate direction information and command selections to processor 910 and to control cursor movement on display device 950. Computing system 900 may also receive user input from a remote device that is communicatively coupled to computing system 900 via one or more network interfaces 980.

Computing system 900 can further include an audio, video, or audio/video processor 970. An audio processor may include a digital signal processor, memory, one or more analog to digital converters (ADCs), digital to analog converters (DACs), digital sampling hardware and software, one or more coder-decoder (coded) modules, and other components. A video processor can include one or more video encoders, camera, display, and the like. The audio or video processor may implement gamma functions and modify resistor segments to improve display performance parameters as described herein.

Computing system 900 further may include one or more network interface(s) 980 to provide access to a network, such as a local area network. Network interface(s) 980 may include, for example, a wireless network interface having antenna 985, which may represent one or more antenna(e). Computing system 900 can include multiple wireless network interfaces such as a combination of WiFi, Bluetooth® and cellular telephony interfaces. Network interface(s) 980 may also include, for example, a wired network interface to communicate with remote devices via network cable 987, which may be, for example, an Ethernet cable, a coaxial cable, a fiber optic cable, a serial cable, or a parallel cable.

In one embodiment, network interface(s) 980 may provide access to a local area network, for example, by conforming to IEEE 802.11 b and/or IEEE 802.11 g standards, and/or the wireless network interface may provide access to a personal area network, for example, by conforming to Bluetooth standards. Other wireless network interfaces and/or protocols can also be supported. In addition to, or instead of, communication via wireless LAN standards, network interface(s) 980 may provide wireless communications using, for example, Time Division, Multiple Access (TDMA) protocols, Global System for Mobile Communications (GSM) protocols, Code Division, Multiple Access (CDMA) protocols, and/or any other type of wireless communications protocol.

In accordance with various aspects of the subject disclosure, a display control circuitry with a display is provided. The display control circuitry includes a plurality of amplifiers to drive gamma signals for a pixel array having a plurality of pixels of a display and a segmented resistor string coupled to the plurality of amplifiers. The resistor string includes a plurality of resistor segments with a resistor segment being designed with a modified resistance to modify display performance parameters including at least one of a settling time of an associated gamma signal, a power supply rejection ratio (PSRR) of an amplifier of the plurality of amplifiers, or an output voltage offset of an amplifier of the plurality of amplifiers.

In accordance with other aspects of the subject disclosure, an electronic device having a display is provided. The display includes a display control circuitry to control operations of the display and column driver circuitry coupled to the display control circuitry. The column driver circuitry comprises a plurality of amplifiers to drive gamma signals for a pixel array having a plurality of pixels of the display and a segmented resistor string coupled to the plurality of amplifiers. The resistor string includes a plurality of resistor segments with at least one resistor segment being designed with a modified resistance to modify display performance parameters including at least one of a settling time of an associated gamma signal, a power supply rejection ratio (PSRR) of an amplifier of the plurality of amplifiers, or an output voltage offset of an amplifier of the plurality of amplifiers.

In accordance with other aspects of the subject disclosure, a display driver circuitry includes a gamma unit to generate a gamma curve for a mapping of luminance to grey level for a display. The gamma unit includes a plurality of amplifiers to drive gamma signals for a pixel array having a plurality of pixels of a display and a segmented resistor string coupled to the plurality of amplifiers. The resistor string includes a plurality of resistor segments with a resistor segment being designed with a modified resistance to modify display performance parameters including at least one of a settling time of an associated gamma signal, a power supply rejection ratio (PSRR) of an amplifier of the plurality of amplifiers, or an output voltage offset of an amplifier of the plurality of amplifiers.

In accordance with other aspects of the subject disclosure, a computer implemented method for a display includes monitoring, with processing circuitry, display performance parameters of the display, determining, with the processing circuitry, whether any display performance parameter including at least one of a settling time of an associated gamma signal, a power supply rejection ratio (PSRR) of an amplifier, or an output voltage offset of an amplifier is out of an electrical specification, and determining at least one resistor segment of a segmented resistor string of a gamma unit that corresponds with the display performance parameter being out of the electrical specification.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the electrical specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

The phrase "at least one of A and B" should be understood to mean "only A, only B, or both A and B." The phrase "at least one selected from the group of A and B" should be understood to mean "only A, only B, or both A and B." The phrase "at least one of A, B, or C" should be understood to mean "only A, only B, only C, or any combination of A, B, or C."

What is claimed is:

1. A display control circuitry, comprising:

a plurality of amplifiers to drive gamma signals for a pixel array having a plurality of pixels of a display;

a segmented resistor string coupled to an output of an amplifier of the plurality of amplifiers; and processing circuitry configured to determine whether any display performance parameter is out of an electrical specification, to determine a resistor segment of the segmented resistor string that corresponds with the display performance parameter being out of the electrical specification, and to modify a total resistance for the resistor segment of the segmented resistor string while maintaining a resistance ratio for resistors within the resistor segment to modify a display performance parameter including at least one of a settling time of an associated output gamma signal of the amplifier, a power supply rejection ratio (PSRR) of the amplifier to indicate an ability to suppress power supply variations, or an output voltage offset of the amplifier that is caused by mismatching from input terminals of the amplifier.

2. The display control circuitry of claim 1, wherein the processing circuitry is configured to determine whether a display performance parameter including the settling time of the associated output gamma signal of the amplifier is outside of an electrical specification, to determine the resistor segment that corresponds with the display performance parameter, and to modify the resistor segment from a first resistance to a second reduced resistance.

3. The display control circuitry of claim 2, wherein modifying the resistor segment from the first resistance to the second resistance reduces the settling time of the associated gamma signal.

4. The display control circuitry of claim 2, wherein the resistor segment comprises a plurality of resistors with a resistance ratio between resistors of the resistor segment being maintained when the first resistance is modified to the second resistance.

5. The display control circuitry of claim 4, wherein a resistance of each resistor of the resistor segment is reduced by a same scaling factor to maintain the resistance ratio when the first resistance is modified to the second resistance for the resistor segment.

6. The display control circuitry of claim 2, wherein the processing circuitry is further configured to force a tapping voltage that is associated with the resistor segment to be the same when the first resistance is modified to the second resistance.

7. The display control circuitry of claim 1, wherein the gamma signals provide a gamma function for correcting image data to be displayed on the display.

8. An electronic device having a display, the electronic device comprising:

display control circuitry to control operations of the display; and column driver circuitry coupled to the display control circuitry, wherein the column driver circuitry comprises a plurality of amplifiers to drive gamma signals for a pixel array having a plurality of pixels of the display and a segmented resistor string coupled to an output of an amplifier of the plurality of amplifiers, wherein the display control circuitry is configured to determine whether any display performance parameter is out of an electrical specification, to determine a resistor segment of the segmented resistor string that corresponds with the display performance parameter being out of the electrical specification, and to modify a total resistance for the resistor segment of the segmented resistor string while maintaining a resistance ratio for resistors within the resistor segment to modify a display performance parameter including at least one of a settling time of an associated output gamma signal of the amplifier, a power supply rejection ratio (PSRR) of the amplifier to indicate an ability to suppress power supply variations, or an output voltage offset of the amplifier that is caused by mismatching from input terminals of the amplifier.

9. The electronic device of claim 8, wherein the display control circuitry is configured to determine whether at least one display performance parameter including the settling time of the associated gamma signal is outside of an electrical specification, to determine the resistor segment that corresponds with the at least one display performance parameter, and to modify the at least one resistor segment from a first resistance to a second reduced resistance.

10. The electronic device of claim 9, wherein modifying the resistor segment from the first resistance to the second resistance reduces the settling time of the associated gamma signal.

11. The electronic device of claim 9, wherein the resistor segment comprises a plurality of resistors with a resistance ratio between resistors of the resistor segment being maintained when the first resistance is modified to the second resistance.

12. The electronic device of claim 11, wherein a resistance of each resistor of the resistor segment is reduced by a same scaling factor to maintain the resistance ratio when the first resistance is modified to the second resistance for the at least one resistor segment.

13. The electronic device of claim 9, wherein the display control circuitry is further configured to force a tapping voltage that is associated with the at least one resistor segment to be the same when the first resistance is modified to the second resistance.

14. The electronic device of claim 8, wherein the gamma signals provide a gamma function for correcting image data to be displayed on the display.

15. A display driver circuitry, comprising:

a gamma unit to generate a gamma curve for a mapping of luminance to grey level for a display, wherein the gamma unit includes a plurality of amplifiers to drive gamma signals for a pixel array having a plurality of pixels of a display and a segmented resistor string coupled to an output of an amplifier of the plurality of amplifiers; and processing circuitry coupled to the gamma unit, the processing circuitry is configured to determine whether any display performance parameter is out of an electrical specification, to determine a resistor segment of the segmented resistor string that corresponds with the display performance parameter being out of the electrical specification, and to modify a total resistance for the resistor segment of the segmented resistor string while maintaining a resistance ratio for resistors within the resistor segment to modify a display performance parameter including at least one of a settling time of an associated output gamma signal of the amplifier, a power supply rejection ratio (PSRR) of the amplifier to indicate an ability to suppress power supply variations, or an output voltage offset of the amplifier that is caused by mismatching from input terminals of the amplifier.

16. The display driver circuitry of claim 15, wherein the processing circuitry is configured to determine whether a display performance parameter including the settling time of the associated gamma signal is outside of an electrical specification, to determine the resistor segment that corresponds with the display performance parameter, and to modify the resistor segment from a first resistance to a second reduced resistance.

17. The display driver circuitry of claim 16, wherein modifying the resistor segment from the first resistance to the second resistance reduces the settling time of the associated gamma signal.

18. A computer implemented method for a display, comprising:

monitoring, with processing circuitry, display performance parameters of the display;

determining, with the processing circuitry, whether any display performance parameter including at least one of a settling time of an associated gamma signal, a power supply rejection ratio (PSRR) of an amplifier, or an output voltage offset of an amplifier is out of an electrical specification;

determining a resistor segment of a segmented resistor string of a gamma unit that corresponds with the display performance parameter being out of the electrical specification; and modifying a total resistance for the resistor segment of the segmented resistor string of the gamma unit while maintaining a resistance ratio for resistors within the resistor segment to modify a display performance parameter including at least one of a settling time of an associated gamma signal, a power supply rejection ratio (PSRR) of an amplifier of the gamma unit, or an output voltage offset of an amplifier of the gamma unit.

19. The computer implemented method of claim 18, wherein the resistor segment of the gamma unit is coupled to output of the amplifier of the gamma unit.

20. The computer implemented method of claim 19, further comprising:

moving the display performance parameter into the electrical specification in response to the modification of the total resistance of the resistor segment.

* * * * *